United States Patent [19]

Fraioli

[11] Patent Number: 4,477,503

[45] Date of Patent: Oct. 16, 1984

[54] AIR SUPPORTED STRUCTURES HAVING INTERNAL LINERS

[75] Inventor: Donato M. Fraioli, Mamaroneck, N.Y.

[73] Assignee: Air Structures International Inc., Tappan, N.Y.

[21] Appl. No.: 413,265

[22] Filed: Aug. 31, 1982

[51] Int. Cl.³ ..... E04B 1/00

[52] U.S. Cl. ..... 428/102; 52/2

[58] Field of Search ..... 52/2; 428/103, 104, 428/102

[56] References Cited

U.S. PATENT DOCUMENTS

| | | | |
|---|---|---|---|
| 2,465,374 | 3/1949 | Haman et al. | 428/104 |
| 3,839,832 | 10/1974 | Kastner | 52/2 |
| 4,186,530 | 2/1980 | Fraioli | 52/2 |

*Primary Examiner*—John E. Kittle

*Attorney, Agent, or Firm*—Robert E. Burns; Emmanuel J. Lobato; Bruce L. Adams

[57] ABSTRACT

An air supported structure comprised of flexible panels joined together along flexible joints and including liner panels suspended between the flexible joints at which the panels are joined. The liner panels are suspended from strips of material which extend along the flexible joints between the flexible panels. The flexible joints are made by heat sealing, sewing or both.

14 Claims, 13 Drawing Figures

AIR SUPPORTED STRUCTURES HAVING INTERNAL LINERS

BACKGROUND OF THE INVENTION

Air supported structures are known. These structures are generally comprised of a sheet-like flexible member which defines the structure when the air within the air supported structure is at a slightly higher pressure than the air pressure outside of the air supported structure. The flexible sheet-like member is comprised of a plurality of flexible panels which are joined to each other at their respective edge portions.

The construction of an air supported structure necessarily involves compromises when selecting among materials having different properties. The flexible panels comprising the sheet-like member of the air supported structure are desirably made from a strong, durable, scuff-proof light weight material that is weather resistant and resistant to airborne pollutants. Additionally, the material should be flexible and easily attached to other panels of the material to form a strong composite structure resulting in an air supported structure that resists tearing, including tearing along the joints where the panels are joined.

No particular material has been found to be completely satisfactory for air supported structures. Some materials might be easy to work and are easily joined, such as, for example, by thermal welding. However, these materials do not have all of the desirable mechanical properties such as scuff resistance and resistance to weather and airborne chemical pollutants. Other materials exhibit many desirable mechanical properties, however, they cannot be thermally welded or easily secured together to establish strong moistureproof joints or seams.

It is also desirable for many applications of air supported structures to provide the air supported structures with internal liners. These internal liners are comprised of liner panels attached to the sheet-like flexible member of the air supported structure and define an air pocket or space between the liner panels and the sheet-like flexible member. The air pocket or air space acts as a thermal barrier to insulate the air supported structure. The provision of a liner in an air supported structure also raises problems of material compatability between the material from which the sheet-like flexible member is made and the material from which the liner panels are made. Additionally, structure must be provided for attaching the liner panels to the sheet-like flexible member.

SUMMARY OF THE INVENTION

It is therefore an object of the invention to provide a new seam structure for an air supported structure.

It is another object of the invention to provide an air supported structure comprised of panels that are securely joined together along moistureproof seams.

It is still another object of the invention to provide a moistureproof seam structure for joining together panels of flexible material.

Still another object of the invention is to provide an air supported structure having an internal liner.

According to the invention an air supported structure is comprised of a sheet-like flexible member dimensioned and configured to define an air supported structure that is when disposed upon a surface on which the air supported structure is to be erected. The sheet-like member comprises a plurality of flexible panels joined together along adjacent edge portions which define flexible joints of the sheet-like member. Means for joining the adjacent edge portions of the plurality of flexible panels are provided. Strips of material are disposed on respective flexible joints of the sheet-like member within the air supported structure, and the strips of material extend along the lengths of the flexible joints and have a tab portion extending along the length of the strips of material and depending from the sheet-like member when the air supported is in an inflated condition. Liner panels span between the tabs, are attached to the tabs and depend from the sheet-like member within the air supported structure when the sheet is inflated. The liner panels together comprise a liner of the air supported structure, and means for attaching the liner panel to the tabs are provided.

The means for joining adjacent edge portions of the plurality of flexible panels is comprised of welded portions of the overlapping marginal edge portions of the panels. In another embodiment the flexible panels are positioned with their respective first outer layers all facing outwardly of the air supported structure, and the panels are positioned with their respective edge portions overlapping and folded back to interleave the overlapping panel edge portions. The means for joining adjacent panel edge portions is comprised of at least one row of stitches extending along the length of the overlapping interleaved panel edge portions and stitched through the interleaved edge portions of the panel sections for joining the panel sections along their edge portions.

The flexible joints of the sheet-like member have a respective single strip of material disposed thereon with a tab portion depending from the sheet-like member when the air structure is inflated. The tab portions have a respective pair of liner sections attached thereto and which extend away from the tab portions in opposite directions. In another embodiment the flexible joints of the sheet-like member have a respective pair of strips of material disposed thereon each with a tab portion depending from the sheet-like member when the air structure is inflated. Each of the tabs have attached thereto a respective liner panel which extends away from the tab and which extends away from the liner panel attached to the other tab of the pair of tabs.

The means for attaching the liner panels to the tabs is comprised of welded portions of the liner panels and tabs. In another embodiment releasable means for attaching the liner panels and the tabs is provided. The releasable means for attaching may be comprised of snaps, buttons or other connectors.

In another embodiment of the invention the liner structure is comprised of layers of liners. Liner panels are attached to the tabs depending from the flexible sheet-like member as previously described. A second layer of liner panels is attached to the first layer of liner panels and defines air pockets or air spaces between the liner panels. These air pockets or spaces between the liner panels constitute a thermal barrier.

Still another embodiment of the air supported structure includes vertical hanging deflectors depending from the sheet-like flexible member. The vertically hanging deflector panels are suspended from the tabs and are attached to the tabs permanently by welding or releasably by releasable connectors.

According to another aspect of the invention a pair of multilayered sheets each comprise a first outer layer and a heat sealable material second outer layer. The pair of sheets are positioned with their respective first outer layers and second outer layers facing in the same directions, and the pair of sheets are positioned with their respective edge portions overlying and folded back with the folded back portions interleaved with each other. Fastening means fastens the folded back interleaved edge portions of the pair of sheets, and a strip of sheet-like heat sealable material is disposed along the interleaved folded edge portions of the pair of sheets on the heat sealable material layers for sealing the interleaved folded edge portions to render same moistureproof.

The air supported structure is constructed from panels joined together in the combination just described. Panels of multilayered sheets each comprising a first outer layer and a heat sealable material second outer layer are positioned with their respective first outer layers all facing outwardly of the air supported structure, and the panels are positioned with the respective edge portions overlapping and folded back to interleave the overlapping panel edge portions. Fastening means fastens the overlapping interleaved panel edge portions, and a strip of heat sealable sheet-like material is disposed along the overlapping interleaved panel edge portions on the heat sealable outer layers facing inwardly of the air supported structure and sealing the overlapping interleaved panel edge portions to render same moistureproof.

The fastening means comprises at least one row of stitches extending along the length of the overlapping interleaved panel edge portions and stitched through the edge portions of the panel sections for fastening the panel sections along their edge portions. The strips of sheet-like material disposed along the respective panel edge portions are disposed on top of the respective rows of stitches on the heat sealable outer layer of the panels and within the air supported structure for preventing moisture from entering the air supported structure along the stitches.

The air supported structure further comprises liner panels for defining a thermal liner within the air supported structure. The liner panels are attached along edges thereof to the heat sealable surface of the panels comprising the air supported structure, and the liner panels have dimensions effective to allow them to hang from the panels comprising the air supported structure and define an air space therebetween to establish a thermal barrier.

In a preferred embodiment the liner panels are attached to the strips of sheet-like material disposed along the edge portions of the panels comprising the air supported structure. The strips of sheet-like material are disposed along the edge portions of the panels and have free ends free to hang from the panels comprising the air supported structure. The liner panels comprising the thermal liner are fixed to the free ends of the strips of sheet-like material for hanging from the panels comprising the air supported structure. The air spaces between the thermal liners and the panels comprising the air supported structure constitute a thermal barrier.

According to still another aspect of the invention a pair of sheets have overlapping marginal edge portions and are comprised of heat sealable materials. The overlapping marginal edge portions are welded together or heat sealed together to define a flexible joint therebetween. A strip of material extends along the length of the flexible joint and is heat sealed or welded thereto, and the strip of material has a tab portion extending therefrom. Panels of material are connected to the tab for attaching the panels of material to the pair of panels joined along the flexible joint. The air supported structure is constructed from panels joined together in the combination just described.

DETAILED DESCRIPTION OF THE INVENTION

Figure 1:
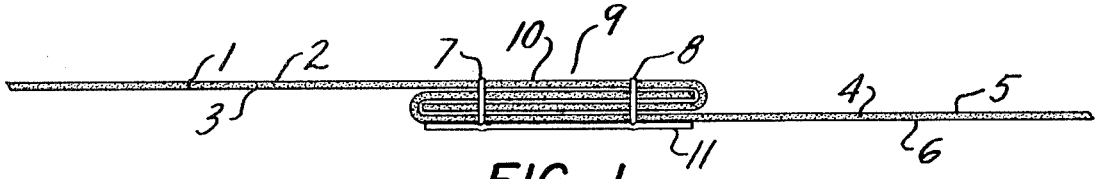
FIG. 1 illustrates a cross section of a pair of multilayered sheets joined together along overlapping edge portions thereof and embodying the flexible joint structure according to the present invention.

A multilayered sheet 1 has a first outer layer 2 made of a scuff-proof weather resistant material. Polyvinylfluoride layers sold under the Trademark TEDLAR are particularly suitable and have proven to be weather and scuff resistant, flexible and yet strong and durable and resistant to airborne pollutants. The multilayer sheet 1 further includes a second outer layer made of a heat sealable or weldable material 3. A second multilayer sheet 4 is likewise comprised of a scuff-proof material first outer layer 5 and a heat sealable material second outer layer 6.

The pair of sheets 1 and 4 are positioned with their respective first outer layers 2 and 5 facing in the same direction and their respective second outer layers 3 and 6 facing in the same direction. The pair of sheets 1 and 4 are positioned with their respective edge portions overlying and folded back with the folded back portions interleaved with each other.

The first sheet 1 has a marginal edge portion 9 folded back and the second sheet 4 likewise has a marginal edge portion 10 folded back. The folded back marginal edge portion 9 of the first sheet 1 is interleaved between the second sheet 4 and its folded back marginal edge portion 10, and the folded back marginal edge portion 10 of the second sheet 4 is similarly interleaved between the first sheet 1 and the folded back marginal edge portion 9 of the first sheet 1.

Rows of stitches 7 and 8 constitute joining means for joining the interleaved folded marginal edge portions of the first and second sheets 1 and 4. Although two rows of stitches 7 and 8 are illustrated, a different number of rows of stitches is also within the scope of the invention. Likewise, structure other than stitches that consitute joining means is also within the scope of the present invention, as described below.

A strip 11 of sheet-like heat sealable material is disposed along the interleaved folded marginal edge portions of the first and second sheets 1 and 4 for sealing the interleaved folded marginal edge portions to render same moistureproof. The strip 11 of sheet-like material is disposed on the heat sealable side 6 of the sheet 4 and is heat sealed or welded thereto. The strip 11 prevents moisture from seeping along the stitches 7 and 8 so that the resulting seam is mechanically strong and moistureproof.

The seam structure illustrated in FIG. 1 is shown with substantial gaps between the various layers constituting the seam structure. These gaps, however, are shown for purposes of clarity. In practice, the stitches 7 and 8 will hold the interleaved edge portions of the sheets 1 and 4 snugly and in contact with each other as shown in FIG. 2.

Figure 2:
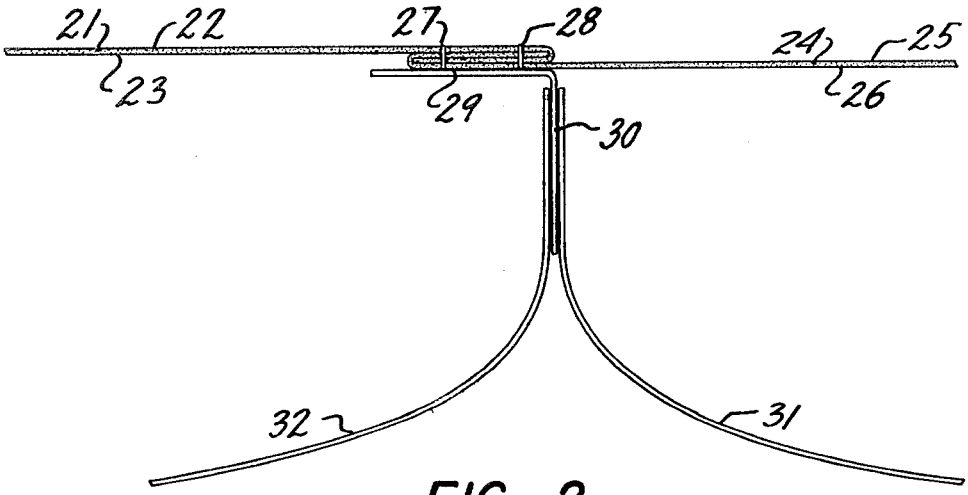
FIG. 2 illustrates a cross section of a pair of panels joined at a joint having structure according to the invention and a pair of liner panels attached thereto.

FIG. 2 of the application illustrates another embodiment of the invention for use in an air supported structure. A first sheet 21 and a second sheet 24 have respective scuff-proof layers 22 and 25, and heat sealable or weldable layers 23 and 26. The layers 22 and 25 face the same direction, and the layers 23 and 26 also face the same direction. The sheets 21 and 24 are joined together along their marginal edge portions by a seam structure comprised of folded back interleaved edge portions of the respective sheets, like the seam structure shown in FIG. 1. Rows of stitches 27 and 28 fasten the sheets together along their folded back interleaved marginal edge portions.

A strip of sheet-like material 29 is disposed along the interleaved folded marginal edge portions of the pair of sheets 21, 24 for sealing the interleaved folded marginal edge portions to render same moistureproof. The strip 29 has a freely hanging portion or tab 30. A thermal liner comprised of liner panels 31 and 32 is attached to the sheets 21, 24 by heat sealing or heat welding the liner panels 31 and 32 to the freely hanging portion 30 of the strip 29.

When the structure shown in FIG. 2 is used in an air supported structure, the layers 22 and 25 of the sheets face the outside of the air supported structure, and the layers 23 and 26 face inwardly of the air supported structure. With the freely hanging portion 30 of the strip 29 hanging downwardly into the air supported structure the liner panels 31 and 32 likewise hang down inwardly of the air supported structure to define spaces between the liner panels and the sheets 21 and 24. The spaces between the liner panels and the sheets comprising the air supported structure are air spaces which constitute a thermal barrier for insulating the air supported structure. As in the embodiment shown in FIG. 1, the strip 29 prevents moisture from entering the space between the sheets 21 and 24 and the thermal liners.

Figure 4:
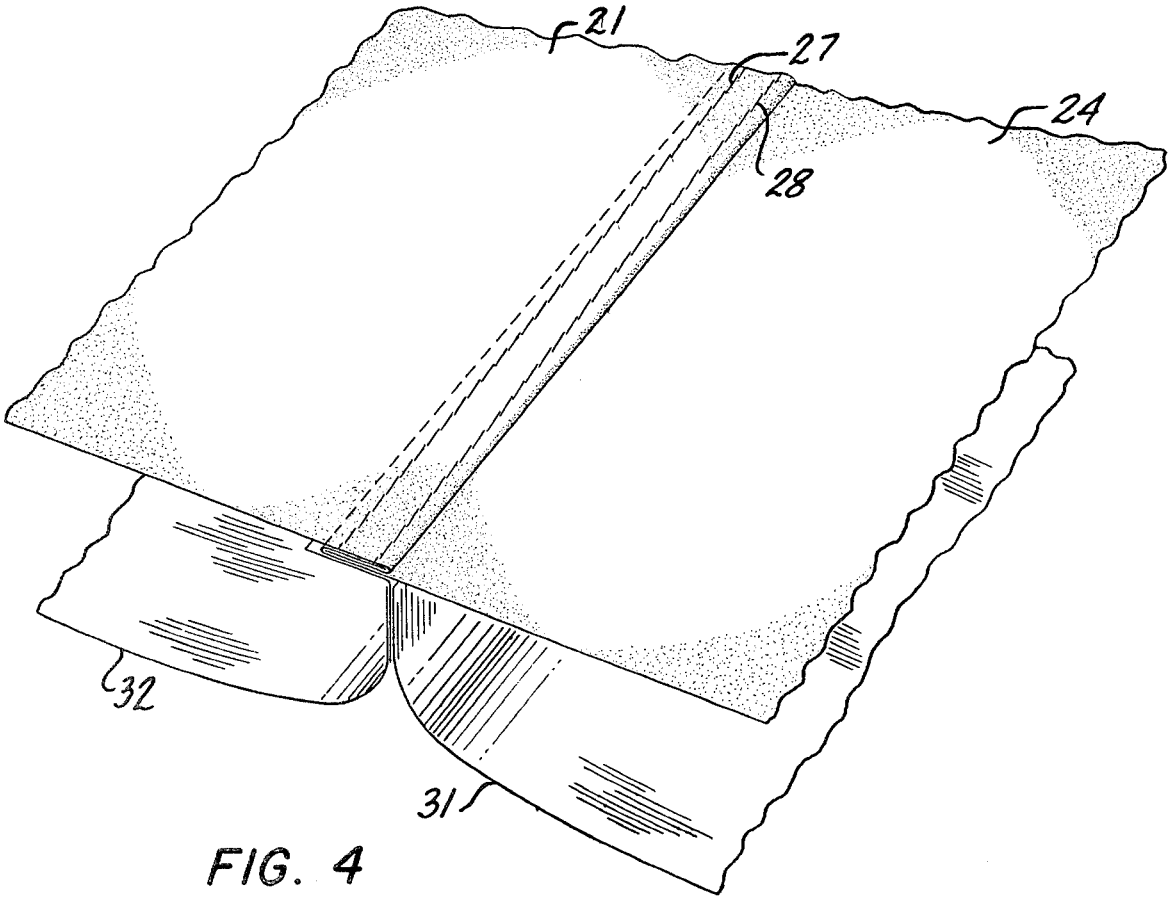
FIG. 4 is an isometric view of the structure illustrated in FIG. 2.

FIG. 4 is an isometric view of the structure shown in FIG. 2. The layers 21 and 24 of the multilayered sheets are on the outside of the air supported structure, and the liner panels 31 and 32 hang downwardly inwardly of the air supported structure.

Figure 3:
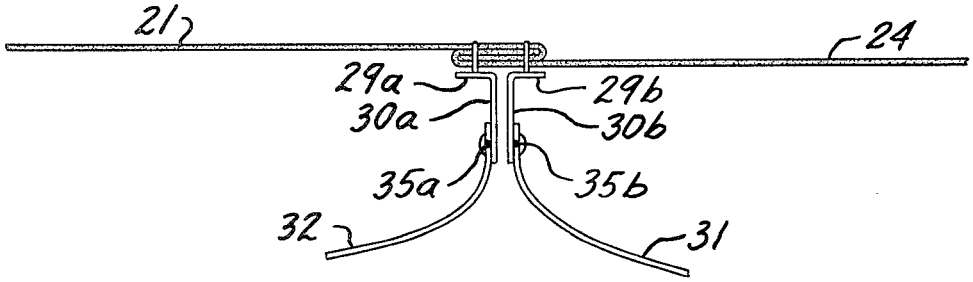
FIG. 3 illustrates a cross section of a pair of panels joined at a joint having structure according to the invention and a pair of liner panels attached thereto according to another embodiment of the invention.

The embodiment of the invention shown in FIG. 3 is similar to that shown in FIG. 2. A sewn seam comprises a flexible joint between a pair of panels. However, in this embodiment a pair of strips of material **29*a*, 29*b* are heat sealed to cover the two rows of stitches which join the pair of panels. Each of the strips of material has a respective hanging portion or tab 30*a*, 30*b* to which is attached one of the liner panels 31 and 32. The liner panels 31 and 32 are attached to the tabs 30*a* and 30*b* by releasable connectors 35*a* and 35*b*. This permits the liner panels to be replaced or removed without requiring the strips of material 29*a* and 29*b*** to be removed.

Figure 5:
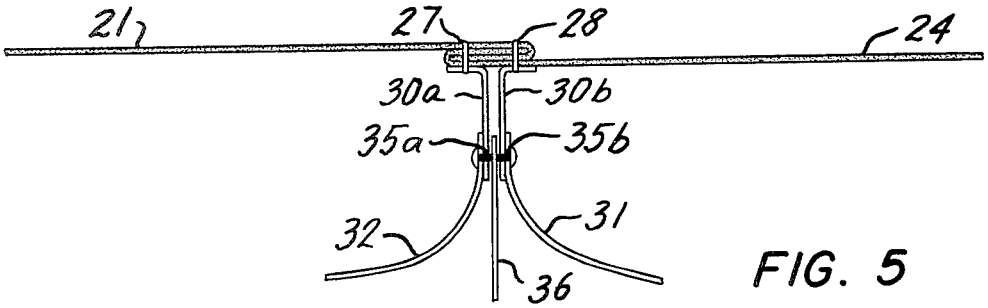
FIG. 5 illustrates a cross section of a pair of panels joined at a seam having structure according to the invention and a pair liner panels attached thereto according to another embodiment of the invention.

FIG. 5 shows an embodiment of the invention similar to that shown in FIG. 3 but additionally comprising a vertically hanging panel 36. The vertically hanging panel 36 depends downwardly from the pair of joined panels 21 and 24, and it is attached to the depending tabs **30*a* and 30*b* by the releasable connectors 35*a* and 35*b*. Thus, the vertically hanging panel 36 can be removed just like the liner panels 31 and 32**.

Figure 6:
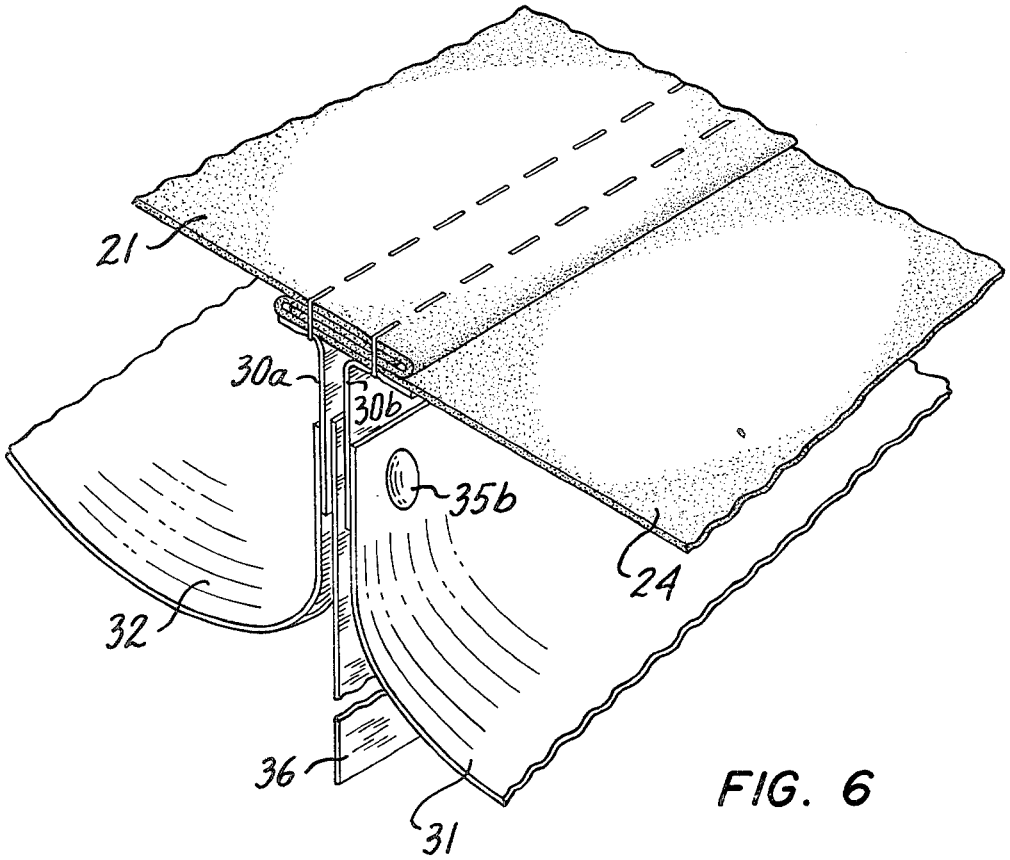
FIG. 6 is an isometric view of the structure illustrated in FIG. 5.

FIG. 6 is an isometric view of the structure shown in FIG. 5. The releasable connectors **35*a* and 35*b* can be any conventional structure such as conventional snaps or buttons. Removal of the vertically hanging panel 36 converts the structure shown in FIG. 5 to the structure shown in FIG. 3**.

Figure 7:
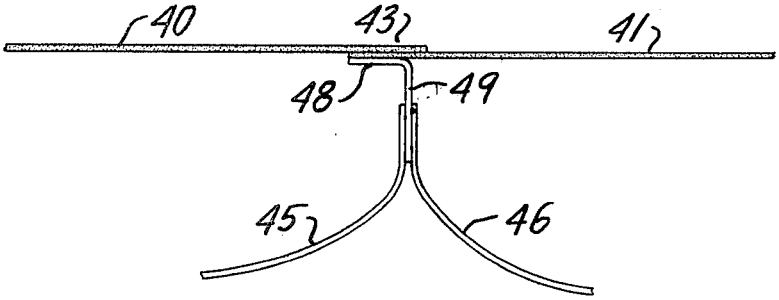
FIG. 7 illustrates a cross section of a pair of sheets joined together along overlapping edge portions thereof according to a second embodiment of the flexible joint structure according to the present invention.

The embodiment of the invention shown in FIG. 7 is comprised of a pair of panels of heat sealable material 40 and 41. Overlapping marginal edge portions of the heat sealable panels 40 and 41 are heat sealed or welded together to define a flexible joint 43. Panels 45 and 46 are attached along the flexible joint by a strip of material 48 having a depending tab 49. The strip of material 48 is heat sealed to and extends along the flexible joint 43, and the depending tab 49 likewise extends along the flexible joint 43. The panels 45 and 46 are heat sealed or welded to the depending tab 49.

Figure 8:
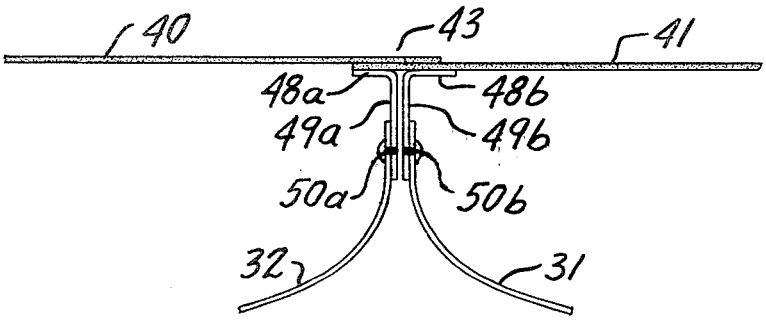
FIG. 8 illustrates a cross section of a pair of sheets joined together along overlapping edge portions thereof and comprising a second embodiment of the flexible joint structure according to the present invention and having a pair of liner panels attached thereto.

The embodiment shown in FIG. 8 is similar to that shown in FIG. 7, except that a pair of strips of material **48*a*, 48*b* are heat sealed and extend along the flexible joint 43. Each of the strips of material 48*a* and 48*b* has a respective depending tab 49*a* and 49*b* to which a respective one of the panels 31 and 32 is attached. In the embodiment shown in FIG. 8 the panels 31 and 32 are releasably attached by releasable connectors 50*a* and 50*b*. However, the releasable connectors 50*a* and 50*b* could be dispensed with and the panels 31 and 32** could be permanently attached to the depending tabs by heat sealing or welding.

Figure 9:
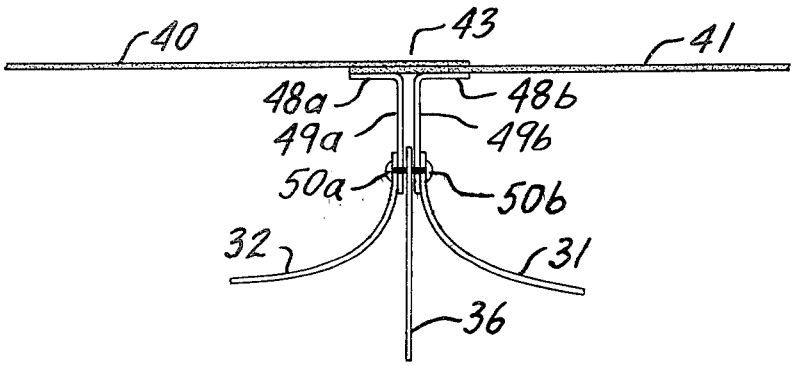
FIG. 9 illustrates a cross section of a pair of sheets joined together with the flexible joint structure according to the invention shown in FIGS. 7 and 8, and having a pair of liner panels releasable connected thereto.

The embodiments shown in FIG. 9 is almost identical to that shown in FIG. 8, but additionally includes a vertically hanging panel 36 which hangs downwardly from the flexible joint 43 at which the panels 40 and 41 are joined. The vertically hanging panel 36 is releasably connected by the releasable connectors **50*a* and 50*b***. Removal of the vertically hanging panel converts the structure shown in FIG. 9 to the structure shown in FIG. 8.

The application of the joint structure and liner structure according to the invention to an air supported structure is more fully shown in FIGS. 10–13. The air supported structure is generally comprised of a plurality of panels joined together at regularly spaced flexible joints. Thus, panels 40, 41 and 42 are joined together at flexible joints 43 and 44 which have any of the structure described above. Liner panels 45, 46 and 47 hang downwardly within the air supported structure and define air spaces for creating a thermal barrier. Because the liner panels are light and flexible the air supported structure can be deflated and stored compactly even with the additional material layers added by the liner panels.

Figure 11:
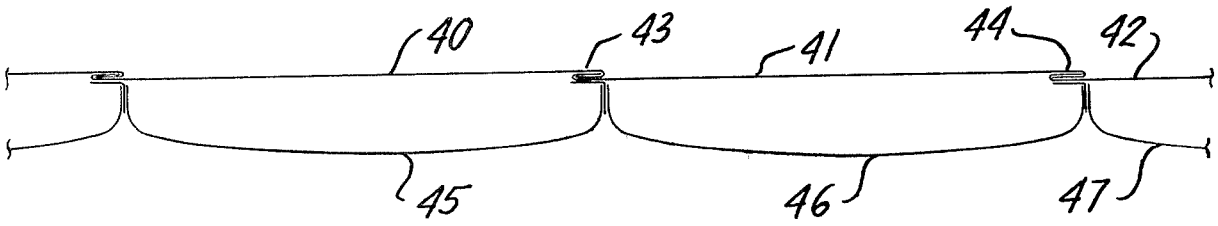
FIG. 11 illustrates a cross section of a plurality of panels and liner panels of the air supported structure shown in FIG. 10.
Figure 10:
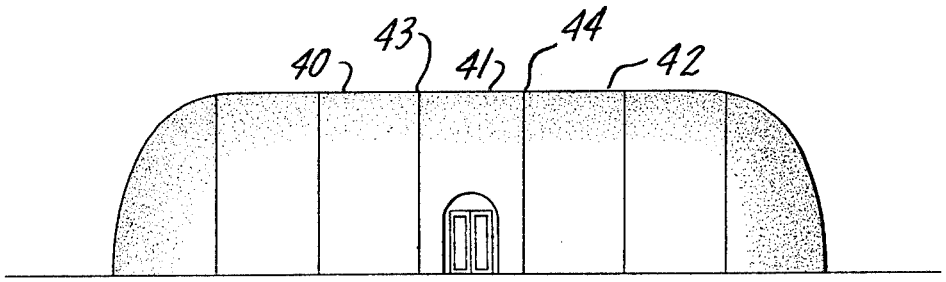
FIG. 10 illustrates an air supported structure.

In the embodiments of the air structure shown in FIGS. 10 and 11 the flexible sheet-like member of the air structure, which is comprised of a plurality of flexible panels 40 and 41, is unconstrained by any structure external thereto. The sheet-like flexible member is dimensioned and configured to define the shape of the air supported structure, and the air supported structure is erected by placing the flexible sheet-like member on the surface on which it is to be erected, and then by inflating the flexible sheet-like member.

The liner panels illustrated throughout the application have been shown without any particular features. In practice, for some applications, it may be advantageous to use perforated liner panels for facilitating some heat flow from inside the air supported structure to the flexible sheet-like member of the air supported structure. The particular size and configuration of the perforations or other openings through the liner panels are selected according to climatic and environmental conditions.

Frequently, air supported structures include an outer cable network disposed over the sheet-like member and configured in the shape of the air supported structure for constraining the sheet-like member to retain the shape of the air supported structure. The cable network provides stress relief to the sheet-like member. An embodiment of an air supported structure according the the invention having an external cable network is shown in FIGS.12 and 13.

Figure 12:
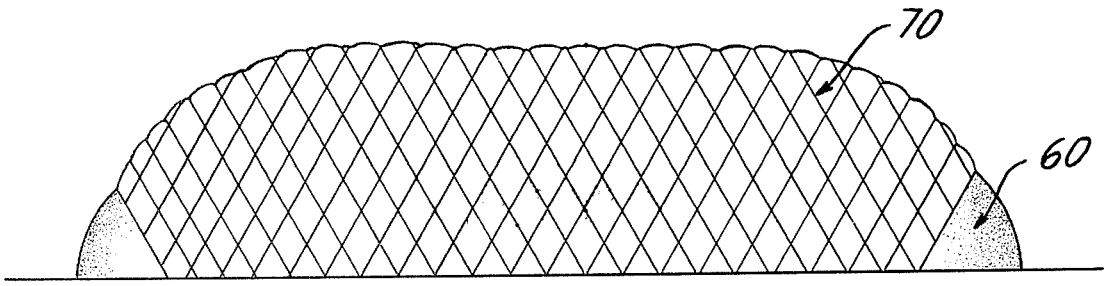
FIG. 12 illustrates another air supported structure having an external cable net for stress relief.

FIG. 12 illustrates an air supported structure having a flexible sheet-like member 60 configured in the shape and size of the air supported structure and in an inflated condition. A cable network 70 overlies the air supported structure and is also configured and dimensioned to conform to the shape of the air supported structure.

Figure 13:
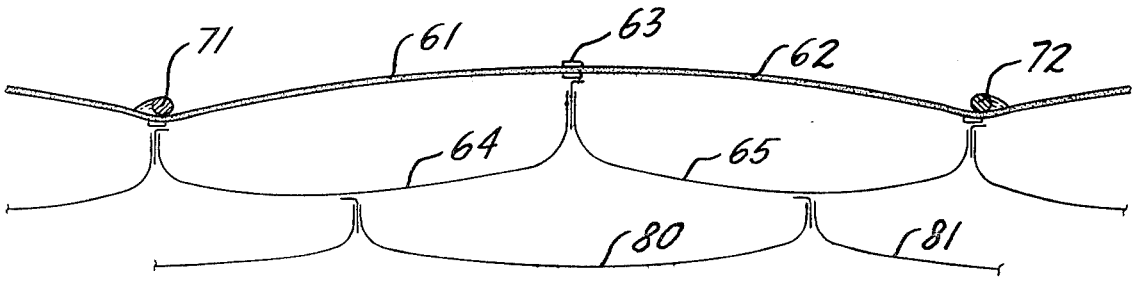
FIG. 13 illustrates a cross section of a plurality of panels and liner panels of the air supported structure shown in FIG. 12.

As shown in FIG. 13, the sheet-like member 60 is comprised of flexible panels 61, 62 joined together along flexible joints 63. Cables 70 and 71 of the cable network 70 overlie the flexible panels comprising the flexible sheet-like member, and liner panels 64 and 65 are attached to the flexible sheet-like member in any of the manners previously described.

The embodiment shown in FIG. 13 further includes a second layer of liner panels 80, 81. The liner panels 80 and 81 are connected to the liner panels 64, 65 in the manner previously described. Most advantageously, the liner panels 80 and 81 are attached to liner panels 64 and 65 by strips of material having dependent tabs which are heat sealed or welded to both the liner panels 64 and 65, and the liner panels 80 and 81. This structure defines a double layered thermal barrier for providing a high degree of thermal insulation in applications which require this. The structure shown in FIG. 13 can further include vertically hanging panels in the manner previously described.

It will be appreciated that the invention is not restricted to the particular embodiments illustrated herein. The stitched structure and heat sealed structure for joining adjacent panels along their overlapping folded and interleaved edges can be replaced or augmented by some other joint structure. Likewise, the liner panels do not have to be hung from strips of material used to seal the flexible joints; instead, separate hangers between the flexible joints can be provided for suspending the liner panels. Accordingly, the invention is defined by the following claims:

I claim:

1. An air supported structure comprising: a sheet-like flexible member dimensioned and configured to define an air supported structure that is inflatable when disposed upon a surface on which the air supported structure is to be erected, said sheet-like member comprising a plurality of flexible panels joined together along adjacent marginal edge portions which define flexible seams of said sheet-like member; means for joining said adjacent marginal edge portions of said plurality of panels; strips of material disposed on respective flexible seams of said sheet-like member within the air structure, said strips of material extending along the lengths of said flexible seams and said strips of material each having a tab portion extending along the length of said strips of material and freely depending from said sheet-like member when the air supported structure is in an inflated and air-supported condition; liner panels spanning between said tabs, attached to said depending tabs and depending from said sheet-like member within the air supported structure when said sheet-like member is in an inflated and air-supported condition, said liner panels together comprising a liner of the air supported structure; and means for attaching said liner panels to said depending tabs.

2. An air supported structure according to claim 1, said plurality of panels are comprised of a heat sealable material and adjacent ones of said panels have their respective marginal edge portions overlapping and welded to join said adjacent panels, and wherein the overlapping marginal edge portions of said panels comprise said flexible seams of said sheet-like member; and said means for joining adjacent marginal edge portions of said plurality of panels is comprised of welded portions of the overlapping marginal edge portions of said panels.

3. An air supported structure according to claim 1, wherein said plurality of panels each comprise a first outer layer and a heat sealable material second outer layer, said panels are positioned with their respective first outer layers all facing outwardly of the air supported structure, and said panels are positioned with their respective edge portions overlapping and folded back to interleave the overlapping panel marginal edge portions; and said means for joining is comprised of at least one row of stitches extending along the length of the overlapping interleaved panel marginal edge portions and stitched through said interleaved marginal edge portions of the panel sections for joining said panel sections along their marginal edge portions.

4. An air supported structure according to claim 1, 2 or 3, wherein said flexible seams of said sheet-like member have a respective single strip of material disposed thereon with a tab portion depending from said sheet-like member when the air structure is inflated an air-supported condition, and the tab portions have a respective pair of liner sections attached thereto and which extend away from said tab portions in opposite directions.

5. An air supported structure according to claim 1, 2 or 3, wherein said flexible seams of said sheet-like member have a respective pair of strips of material disposed thereon each with a tab portion depending from said sheet-like member when the air structure is inflated, each of said tabs having attached thereto a respective liner panel which extends away from the tab and which extends away from the other liner panel.

6. An air supported structure according to claim 1 wherein said flexible seams of said sheet-like member are comprised of pairs of adjacent panel marginal edge portions overlapping and welded together, said flexible joints have disposed thereon strips of material within the air supported structure, said strips of material each having respective tab portions depending from said sheet-like member, and said liner panels being attached to respective ones of said depending tabs for suspending said liner panels from said sheet-like member when the air structure is in an air-supported condition.

7. An air supported structure according to claim 6, wherein said flexible seams have disposed thereon pairs of strips of material within the air supported structure, said strips of material having respective tab portions depending from said sheet-like member, said liner panels being attached to respective ones of said tabs for suspending said liner panels from said sheet-like member when the air supported structure is in an air-supported condition, and said liners panels being oriented with each pair of liner panels attached to respective tabs of a pair of tabs extending away from each other.

8. An air supported structure according to claim 1, wherein said flexible seams of said sheet-like member are comprised of respective panel adjacent marginal edge portions overlapping and folded back to interleave the overlapping panel marginal edge portions; said means for joining is comprised of at least one row of stitches extending along the length of the overlapping interleaved panel marginal edge portions and stitched through said interleaved marginal edge portions of the panel sections for joining said panel sections along their marginal edge portions.

9. An air supported structure according to claim 6, wherein said means for attaching said liner panels to said tabs are comprised of means for releasably attaching said liner panels to said tabs.

10. An air supported structure according to claim 1 or 6, further comprising vertically hanging panels attached to said tabs and depending from said sheet-like member and within said air supported structure when said sheet-like member is in an air-supported condition, and wherein said means for attaching said liner panels to said tabs are comprised of means for attaching said vertically hanging panels to said tabs.

11. An air supported structure according to claim 8, wherein said means for attaching said liner panels to said tabs comprise means for releasably attaching said liner panels to said tabs.

12. An air supported structure according to claim 1 or 8, further comprising vertically hanging panels attached to said tabs and depending from said sheet-like member within said air supported structure when said sheet-like member is in an air-supported condition, and wherein said means for attaching said liner panels to said tabs comprise means for attaching said vertically hanging panels to said tabs.

13. An air supported structure according to claim 1, further comprising: a plurality of second liner panels attached to and hanging from said liner panels that are attached to said flexible sheet-like member; and means for attaching said plurality of second liner panels to said liner panels that are attached to said flexible sheet-like member.

14. For use in an air-supported structure, in combination:

a first sheet of heat sealable material;

a second sheet of heat sealable material;

said first and second sheets being positioned with a respective marginal edge portion of each of said sheets overlapping a respective edge of the other of said sheets and with the overlapping sheet marginal edge portions heat sealed together to form a flexible seam joining said first and second sheets;

a strip of heat sealable material extending along and heat sealed to the flexible seam between said first and second sheets interiorly of the air supported structure when in an air-supported condition, and said strip of heat sealable material having a tab extending along said strip of heat sealable material and depending therefrom when said air supported structure is an air-supported condition;

at least one panel attached to said tab; and means for attaching said panel to said tab.

* * * * *